US006945308B1

(12) United States Patent
Jones

(10) Patent No.: US 6,945,308 B1
(45) Date of Patent: Sep. 20, 2005

(54) HOT CHAMBER DIE CASTING

(76) Inventor: Melvin A. Jones, 340 E. County Rd. 16, Tiffin, OH (US) 44883

( * ) Notice: Subject to any disclaimer, the term of this patent is extended or adjusted under 35 U.S.C. 154(b) by 0 days.

(21) Appl. No.: 10/790,472

(22) Filed: Mar. 1, 2004

(51) Int. Cl.[7] ..... B22D 17/04
(52) U.S. Cl. ..... 164/113; 164/316
(58) Field of Search ..... 164/316, 312, 164/317, 318, 113

(56) References Cited

U.S. PATENT DOCUMENTS 2,393,588 A * 1/1946 Cherry et al. ..... 164/316
3,727,675 A * 4/1973 Bennett ..... 164/316
4,261,414 A 4/1981 Frenette et al.
4,408,651 A * 10/1983 Smedley et al. ..... 164/316
4,482,001 A 11/1984 Smedley et al.
4,593,741 A 6/1986 Caugherty
4,595,044 A 6/1986 Caugherty et al.
5,971,057 A * 10/1999 Yukisawa et al. ..... 164/113
6,029,737 A 2/2000 Mancini
6,481,489 B1 * 11/2002 Jones ..... 164/316

* cited by examiner

*Primary Examiner*—Len Tran
(74) *Attorney, Agent, or Firm*—Emch, Schaffer, Schaub & Porcello Co., L.P.A.

(57) ABSTRACT

This assembly is for use with hot chamber die casting. More specifically, the assembly is a fast fill bottom fill gooseneck. The intake port has been moved to the bottom of the gooseneck. The bottom intake port has been fitted with an interior plug. When the plunger moves upwardly, it creates a vacuum the pulls the interior plug upwardly. This vacuum also opens the bottom intake port pulling molten metal into the chamber from the reservoir. When the plunger moves downwardly, the interior plug moves downwardly and seals the bottom intake port. As the plunger continues to travel downward, it pressurizes the molten metal and forces the molten metal contained in the cylinder through the channel in the gooseneck, through the nozzle seat and the nozzle into the die cavity of the die thereby filling the cavity and forming the cast part.

26 Claims, 6 Drawing Sheets

HOT CHAMBER DIE CASTING

TECHNICAL FIELD OF THE INVENTION

This invention relates to an assembly for use with hot chamber die casting. More specifically, the assembly includes a bottom fill gooseneck.

BACKGROUND OF THE INVENTION

Die casting machines generally utilize one of two classifications of casting material pumping systems, either a hot chamber system or a cold chamber system. Hot material chamber die casting machines include parts that are partially submerged in a vat containing the molten metal and thus operate at the temperature of the metal bath. Cold chamber die casting machines are unheated except for the die member which receives the molten metal during the casting process. Hot chamber systems are used primarily for the casting of metals having low melting points such as tin, zinc and lead alloys. Cold chamber machines can be used for die casting most metals, however, they are most commonly used for aluminum, magnesium and copper alloys.

The industry has lavished great care in choosing materials for the construction of hot chamber die casting machines. Improved materials for the various parts have led to enhanced resistance against wear, hardening and softening. The industry, however, has had little success in overcoming failure problems resulting from the high operating pressures present in the hot melt die casting process.

A recent, major improvement in the industry has been a reinforced casting. Specifically, the improvement is a reinforced gooseneck and reinforced components for use with a hot chamber die casting machine. The improvement provides for the reinforcement of the gooseneck, nozzle, and nozzle seat. The preferred embodiment focuses on reinforcing the gooseneck as this is the location where most pressure-caused failures occur. See U.S. Pat. No. 6,481,489 issued to Melvin A. Jones which is herein incorporated by reference.

Another problem has been communication between the pressure cylinder of the gooseneck and the molten metal reservoir. Various attempts have been made to fast fill the chamber of the gooseneck or to more completely reach the bottom of the reservoir of molten material. U.S. Pat. No. 4,261,414 discloses a complicated mechanism for rapidly providing molten metal to a die casting machines. This patent discloses a double toggle arrangement including a bell crank pivotally mounted on a yoke. The patent also discloses a double shaft arrangement for filling the chamber of the gooseneck. Shaft 104 operates gate valve 100. Gate valve 100 has two apertures. Aperture 112 provides communication between pump chamber 96 and pot 32. Aperture 114 provides communication between chamber 96 and nozzle 54. Shaft 108 operates pump 110 mounted in chamber 96. Movement of shafts 104 and 108 operate in sync to fill and drain chamber 96 through apertures 112 and 114. Obviously, keeping the shafts in sync would be difficult. While this system may function, it cannot be retrofitted to an existing gooseneck assembly. Maintenance also would be difficult.

BRIEF SUMMARY OF THE INVENTION

I have invented a fast fill assembly that can be retrofitted to an existing gooseneck assembly. In a conventional gooseneck assembly, the intake port typically fills the chamber from the side. See intake post 30 in FIG. 1 of my U.S. Pat. No. 6,481,489. I have moved the intake port to the bottom wall of the gooseneck. I also have fitted the bottom intake port with an interior plug. When the plunger moves upwardly, it creates a vacuum the pulls the interior plug upwardly. The vacuum created by the upwardly moving plunger also pulls or sucks molten metal from the lower portion of the reservoir through the bottom intake port into the chamber. The head of pressure created by the weight of molten metal also forces the molten metal through the open bottom intake port into the chamber. When the plunger moves downwardly, the interior plug moves downwardly and seals the bottom intake port. The interior plug includes a shaft that extends downwardly through the bottom intake port. Preferably, the shaft of the plug includes an exterior plug that prevents the interior plug from loosing communication with the bottom intake port.

The gooseneck and pressure cylinder are partially submerged in the reservoir of molten non-ferrous metal. The intake port provides a passageway between the pressure cylinder and the reservoir. With the plunger in the up position, molten metal is free to flow from the reservoir through the intake port and into the pressure cylinder. When the plunger is moved downward, it seals off the pressure cylinder from the reservoir. As the plunger continues to travel downward, it pressurizes the molten metal and forces the molten metal contained in the cylinder through the channel in the gooseneck, through the nozzle seat and the nozzle into the die cavity of the die thereby filling the cavity and forming the cast part.

Other objects and advantages of the present invention will become apparent to those skilled in the art upon a review of the following detailed description of the preferred embodiments and the accompanying drawings.

DETAILED DESCRIPTION OF THE PREFERRED EMBODIMENT(S)

This assembly for use with hot chamber die casting comprises a gooseneck assembly having a channel extending therethrough, wherein the gooseneck assembly is made from a ferrous material. The gooseneck assembly has an exterior surface, an interior surface and an interior located between the exterior and interior surfaces. The interior surface defines the channel extending therethrough. U.S. Pat. No. 6,481,489 discloses an embodiment where reinforcing members are located in the interior of the gooseneck assembly.

Figure 1:
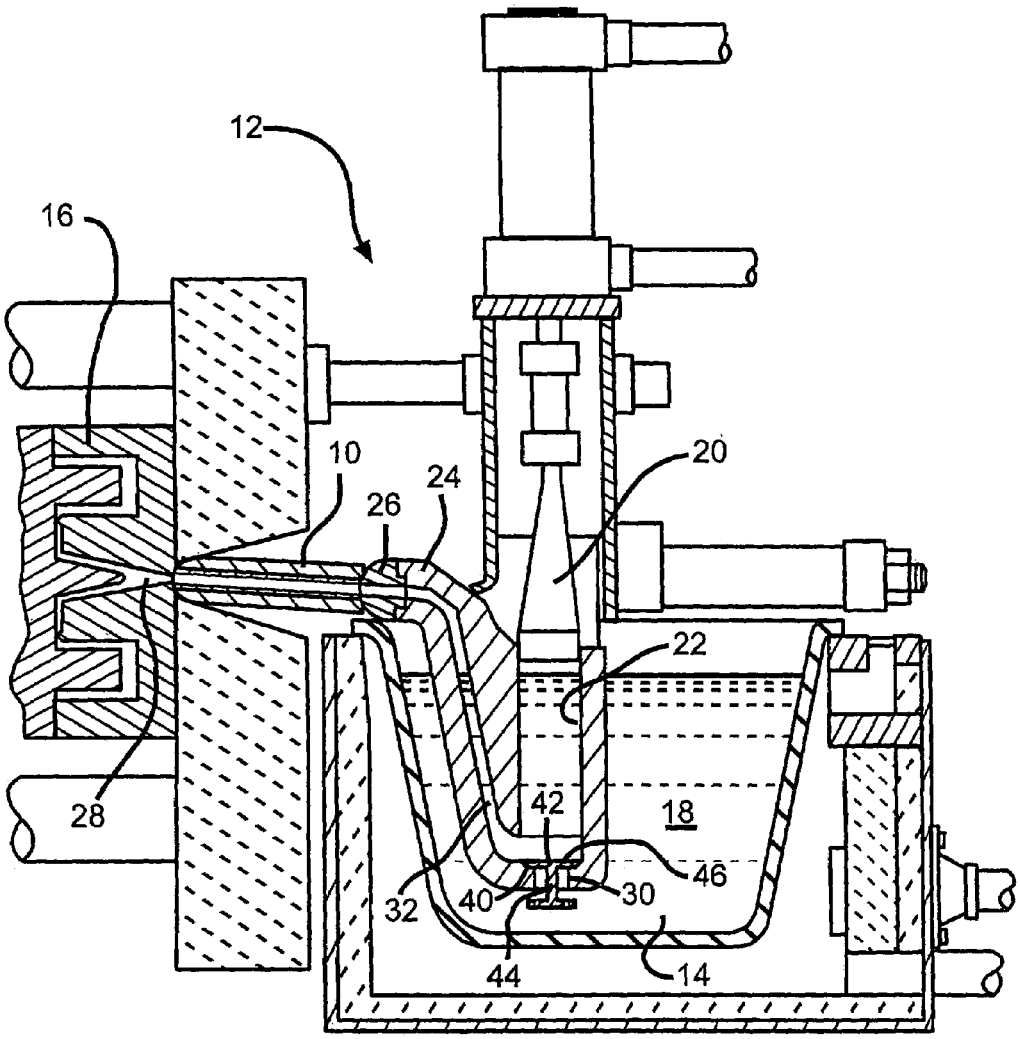
FIG. 1 is a cross-sectional side elevational view of a die casting machine and die according to the present invention with the plug in the down position.

FIG. 1 shows a hot chamber die casting machine having a submerged plunger mechanism, a gooseneck and a nozzle. Machine 12 consists of molten metal reservoir 18, plunger 20, pressure cylinder 22, gooseneck 24, nozzle seat 26 and nozzle 10. Nozzle 10 is designed to matingly engage with die cavity 28 of die 16 so that molten metal 14 is received into die cavity 28 from the machine operation.

Figure 2:
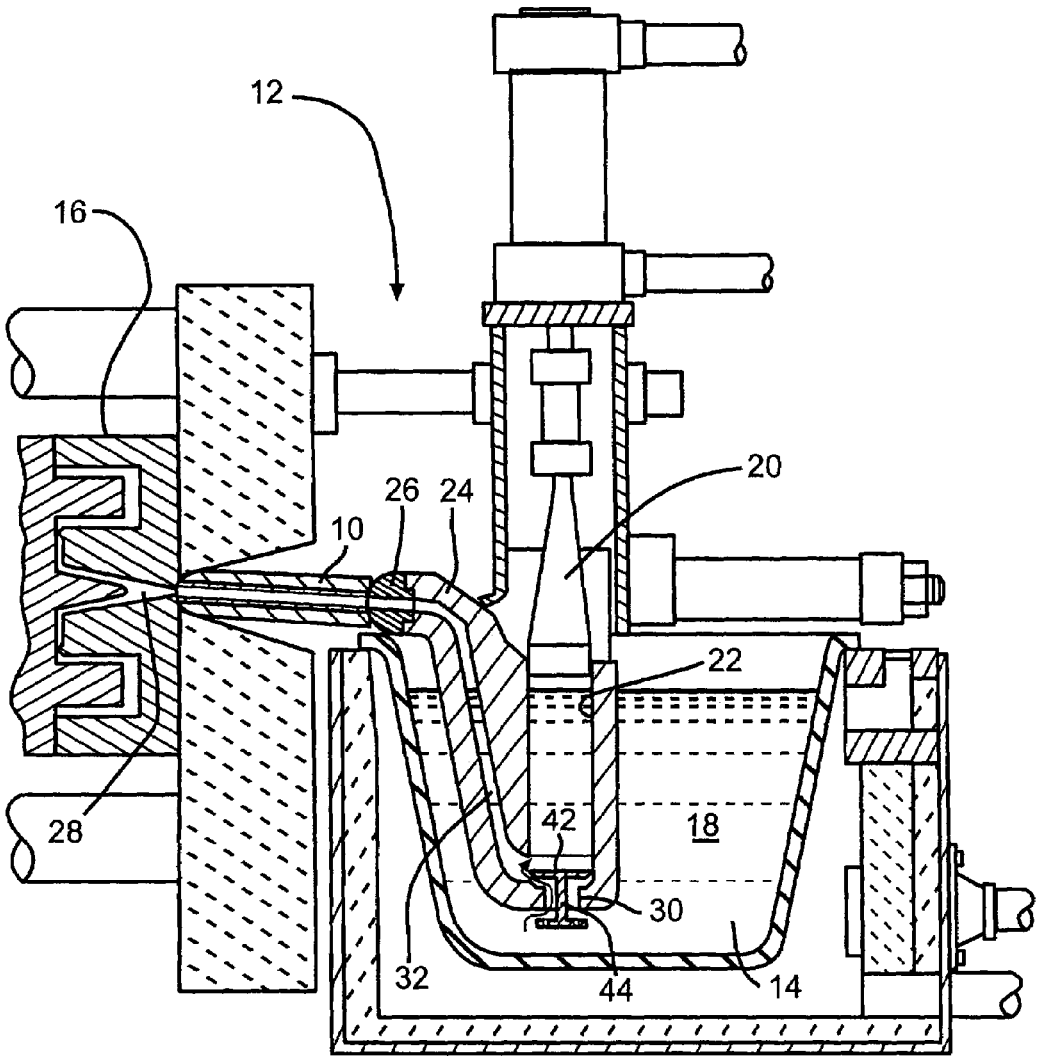
FIG. 2 is a cross-sectional view of FIG. 1 with the plug assembly in the up position.

Gooseneck 24 and pressure cylinder 22 are partially submerged in reservoir 18 of molten non-ferrous metal 14. Bottom intake port 30 provides a passageway between pressure cylinder 22 and reservoir 18. With plunger 20 in the up position (as shown in FIG. 2), molten metal 14 is pulled or forced from reservoir 18 through intake port 30 and into pressure cylinder 22. When plunger 20 is moved downward (as shown in FIG. 1), plug assembly 40 seals off pressure cylinder 22 from reservoir 18 as shown in FIG. 2. As plunger 20 continues to travel downward, it pressurizes molten metal 14 and forces molten metal 14 container in cylinder 22 through channel 32 in gooseneck 24, through nozzle seat 26 and nozzle 10, into die cavity 28 of die 16, thereby filling the cavity and forming the cast part.

After the metal has solidified in die cavity 28, plunger 20 is retracted, thereby uncovering intake port 30 and molten metal again is pulled and forced from reservoir 18 into pressure cylinder 22, thus readying machine 12 for the next cycle.

FIG. 1 shows plug assembly 40 in the downward position. Plug 42 matingly engages interior surface 46 of cylinder 22 and seals off cylinder 22 from reservoir 18.

FIG. 2 shows plug assembly 40 in the up position. Bottom intake port houses (30) plug assembly 40. When plunger 20 is in the up position, plug assembly 40 is in the up position. This provides a passageway between pressure cylinder 22 and reservoir 18. Thus, molten metal 14 is pulled from reservoir 18 through bottom intake port 30 into cylinder 22. When plunger 20 is down, plug assembly 40 is down. This seals off cylinder 22 from reservoir 18.

Plug assembly 40 includes interior plug 42 and shaft 44. Bottom intake port 30 houses shaft 44. Preferably shaft 44 is longer than port 30 and smaller than port 30. Typically port 30 and shaft 44 have a circular cross-section and shaft 44 has a smaller diameter in order to allow molten metal to flow when the assembly 40 is in the up position. The longer length of shaft 44 prevents assembly 40 from being pulled completely out of port 30 into cylinder 22.

Figure 3:
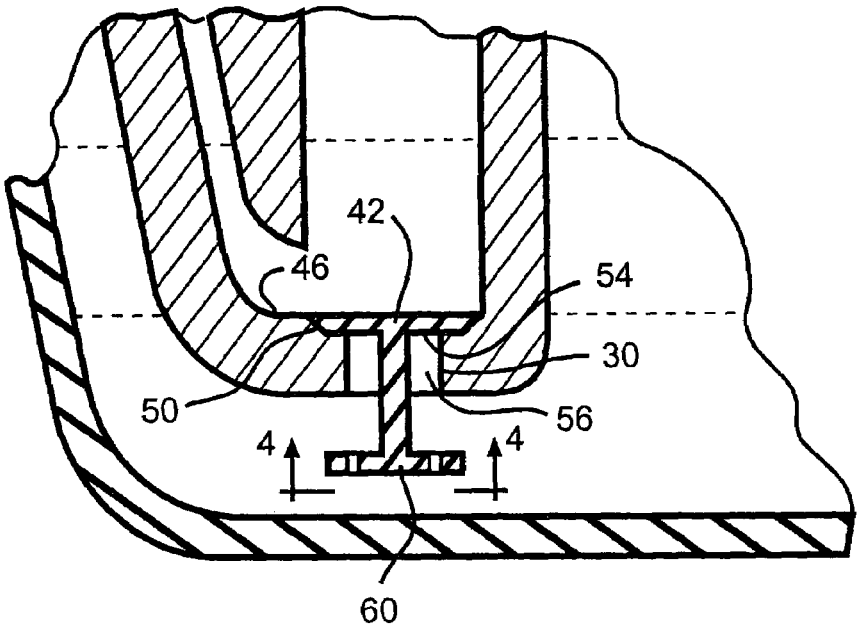
FIG. 3 is a partially exploded view showing a recess for the plug assembly.

FIG. 3 is a partially exploded view showing recess 50 in interior surface 46. Recess 50 houses plug 42 and circumscribes opening 54 of passageway 56 of port 30. Recess 50 preferably enhances the ability of plug 42 to mating engage interior surface 46 and and seal off cylinder 22 from reservoir 18.

Figure 4:
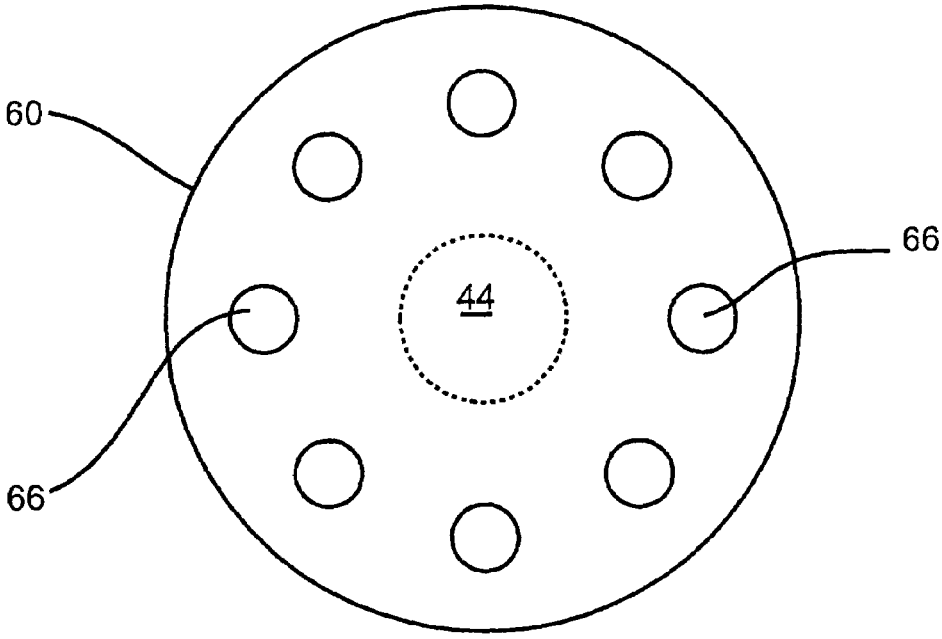
FIG. 4 shows the exterior plug of the plug assembly in greater detail.

FIG. 3 and FIG. 4 shows an embodiment wherein plug assembly 50 including exterior plug 60. Exterior plug 60 engages exterior surface 62 of gooseneck 24 when assembly 40 is in the up position and molten metal is filing cylinder 22. Exterior plug 60 includes at least one aperture 66 therein. Aperture 66 allows molten metal 14 to flow into cylinder 22 through passageway 56. Preferably aperture 66 is a plurality of apertures.

Figure 5:
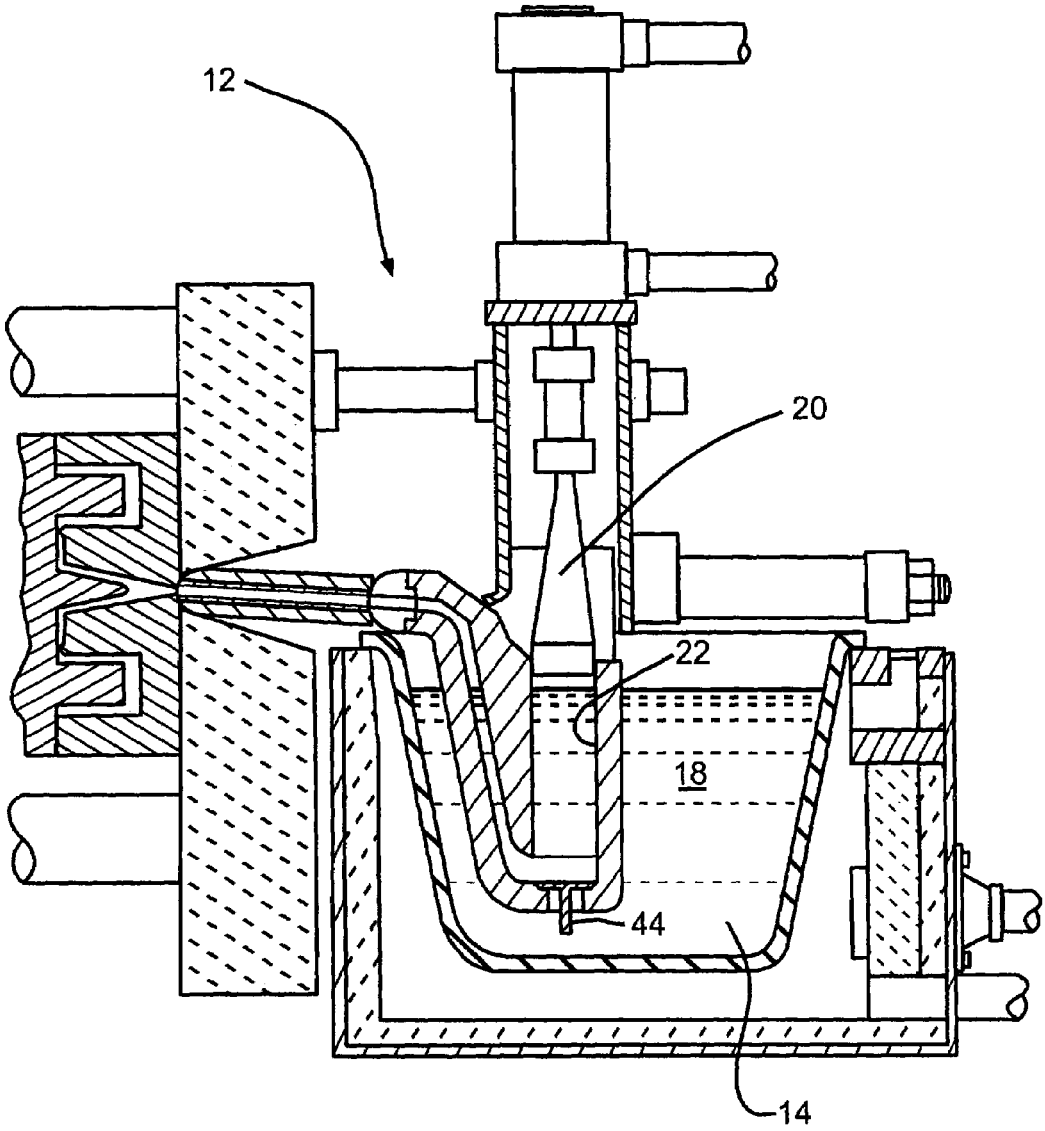
FIG. 5 is a cross-sectional view of FIG. 1 showing the plug assembly without the exterior plug.

FIG. 5 shows plug assembly 40 with interior plug 42 and shaft 44, but without exterior plug 60. Shaft 44 is longer than port 30. The longer length of shaft 44 prevents assembly 40 from being pulled completely out of port 30 into cylinder 22.

Figure 6:
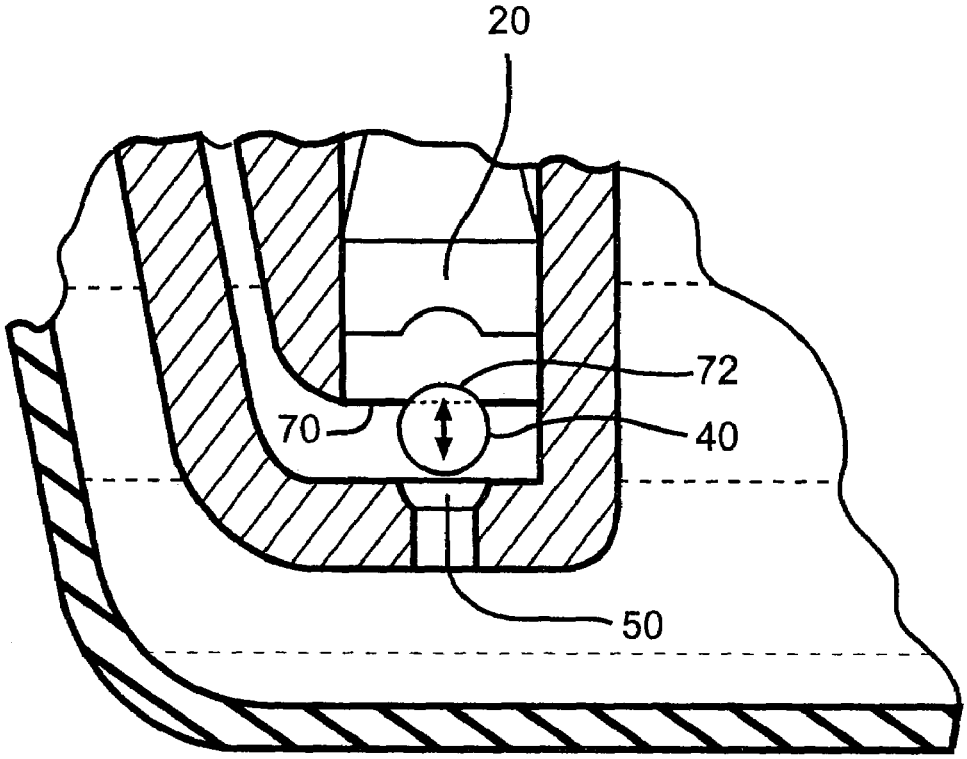
FIG. 6 is a partially exploded view showing a plug assembly which is a ball bearing.

FIG. 6 shows an embodiment wherein assembly 40 is a ball bearing. Preferably recess 50 is used when assembly 40 is a ball bearing. In this embodiment, bottom surface 70 of plunger 20 includes recess 72. Recess 72 matingly engages ball bearing 40 when plunger 20 is in the down position.

Figure 7:
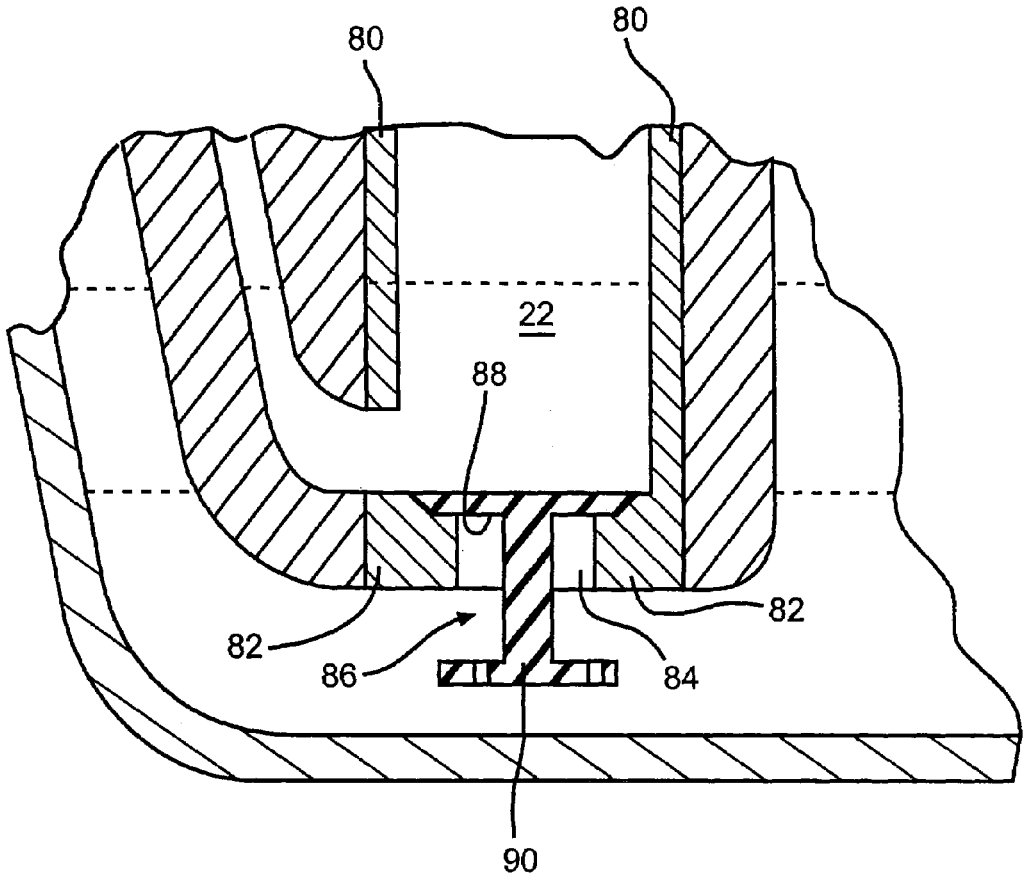
FIG. 7 is a partially exploded view showing a sleeve with the plug assembly in the sleeve.

FIG. 7 is a partially exploded view showing a sleeve with the plug assembly in the bottom of the sleeve. FIG. 7 shows sleeve 80 extending to the bottom of cylinder 22. Sleeve 80 includes sleeve bottom 82 and sleeve port 84. Port 84 houses plug assembly 86 when assembly 40 is in a downward position. Preferably port 84 includes recess 88. Plug assembly 86 includes strainer 90. Plug assembly 86 moves upwardly and downwardly in much the same fashion as does plug assembly 40. Sleeve 80 may be made of grey iron, steel, alloyed steel and the like.

Strainer 90 is similar to exterior plug 60 of FIG. 4 except strainer 90 has a multiplicity of apertures 66. In one embodiment strainer 90 is made of a mesh material.

The process and apparatus of this invention provides for a simpler and faster operation with more shots per hour. Strainer 90 enables cleaner metal into chamber 22. The cleaner molten metal allows for longer sleeve, plug and plunger life. The bottom fill provides a higher and more constant temperature for the molten metal than the traditional top fill arrangements. Bottom fill also reduces or eliminates dross from entering the cylinder. Dross is oxidized molten metal typically found at the top of a molten metal reservoir such as reservoir 18. Dross is a contaminant to the gooseneck and cylinder and shortens the life of the apparatus.

The weight of molten metal 14 in reservoir 18 provides head of pressure necessary to push molten metal 14 from reservoir 18 through bottom intake post 30 into pressure cylinder 22 when plunger 20 moves upwardly. The head of pressure works with the vacuum created by upwardly moving plunger 20 to fill cylinder 22. In a conventional gooseneck assembly, the intake post typically fills the cylinder from the side near the top of the reservoir. The pressure head near the top of the reservoir pot has little or no head of pressure. Bottom filling provides a more efficient, economical and faster drawing of molten metal from the reservoir (pot).

The term "gooseneck" is not to be constructed as meaning "in the shape of a goosenek", but merely an arrangement with a similar function and providing a duct channel or bore for the molten metal to be injected from the cylinder, upwards alongside the cylinder and laterally to a die.

The above description of the invention and the alternative embodiments is intended to be illustrative of the invention as a whole and not limiting up [on the scope of the following claims. It is envisioned that the reinforcing members may be incorporated into any cast member who is exposed to internal pressure and subject to bursting and failure as a result of the pressures.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. An assembly for use with hot chamber die casting comprising a gooseneck assembly having a channel extending therethrough, wherein the gooseneck assembly has an exterior surface, an interior surface and a bottom;

wherein the interior surface defines the channel extending therethrough;

a plunger matingly engaging the channel;

a bottom intake port located in the bottom of the gooseneck wherein the bottom port includes a passageway extending from the exterior surface to the interior surface of the gooseneck; and a plug assembly housed by the bottom intake port; wherein the passageway of the bottom port is open when the plug assembly is in an upper position and the passageway is closed when the plug assembly is in a lower position wherein the plug assembly includes an interior plug and a shaft wherein the interior plug is adjacent the interior surface of the bottom of the gooseneck and wherein the passageway of the bottom port houses the shaft of the plug assembly.

2. An assembly according to claim 1 wherein the shaft of the plug assembly extends beyond the exterior surface of the bottom of the gooseneck.

3. An assembly according to claim 1 wherein the plug assembly includes an exterior plug attached to the shaft adjacent the exterior surface of the bottom of the gooseneck.

4. An assembly according to claim 3 wherein the exterior plug of the assembly includes at least one aperture therethrough.

5. An assembly according to claim 3 wherein the exterior plug of the assembly includes a plurality of apertures therethrough.

6. An assembly according to claim 1 including molten metal reservoir containing molten metal wherein the gooseneck assembly is partially submerged in the molten metal of the reservoir.

7. An assembly according to claim 1 wherein the interior surface of the gooseneck assembly includes a recess adjacent the passageway of the bottom port and wherein the recess houses the interior plug when the plug is in a lower position.

8. An assembly for use with hot chamber die casting comprising a gooseneck assembly having a channel extending therethrough, wherein the gooseneck assembly has an exterior surface, an interior surface and a bottom;

wherein the interior surface defines the channel extending therethrough;

a plunger matingly engaging the channel;

a bottom intake port located in the bottom of the gooseneck wherein the bottom port includes a passageway extending from the exterior surface to the interior surface of the gooseneck; and a plug assembly housed by the bottom intake port; wherein the passageway of the bottom port is open when the plug assembly is in an upper position and the passageway is closed when the plug assembly is in a lower position wherein the plug assembly is a ball bearing and wherein the interior surface of the gooseneck assembly includes a recess adjacent the passageway of the bottom port wherein the recess houses the ball bearing when the ball bearing is in a lower position.

9. An assembly according to claim 8 wherein the plunger has a bottom surface, wherein the bottom surface has a recess and wherein the recess of the plunger houses the ball bearing when the ball bearing is in an upward position.

10. An assembly according to claim 1 wherein a sleeve lines the interior surface defining the channel extending through the gooseneck.

11. An assembly according to claim 10 wherein the sleeve has a bottom, wherein the bottom of the sleeve has a bottom intake port and wherein the port of the bottom of the sleeve includes a passageway extending from the exterior surface to the interior of the gooseneck; and wherein the plug assembly is housed by the bottom intake port of the sleeve and wherein the passageway of the bottom port of the sleeve is open when the plug assembly is in an upper position and the passageway is closed when the plug assembly is in a lower position.

12. An assembly according to claim 11 wherein the plug assembly includes an exterior plug attached to the shaft adjacent the exterior surface of the bottom of the gooseneck, wherein the exterior plug is a strainer.

13. A method for hot chamber die casting comprising the steps of:

providing a gooseneck assembly having a channel extending therethrough, wherein the gooseneck assembly has an exterior surface, an interior surface and a bottom;

providing a plunger matingly engaging the chamber, providing a bottom intake port having a passageway in the bottom of the gooseneck assembly extending from the exterior surface to the interior surface of the bottom of the gooseneck assembly, providing a plug assembly adjacent the bottom port, causing the plunger to move in an upward direction and simultaneously causing the plug assembly to move upwardly and open the passageway of the bottom port, housing the plug assembly in the bottom intake port, including an interior plug and a shaft in the plug assembly locating the interior plug adjacent the interior surface of the bottom of the gooseneck, and housing the shaft of the plug assembly in the passageway of the bottom port.

14. A method according to claim 13 including the steps of:

causing the plunger to move in a downward direction and simultaneously causing the plug assembly to move in a downwardly direction closing the passageway of the bottom port.

15. A method according to claim 14 including the steps of:

providing a molten metal reservoir containing molten metal; and partially submerging the bottom of the gooseneck assembly in the molten metal of the reservoir.

16. A method according to claim 15 wherein the step of moving the plug assembly in a downward direction seals off the chamber from the reservoir.

17. A method according to claim 16 including the steps of continuing to move the plunger in downwardly direction, forcing the molten metal in the cylinder through the channel of the gooseneck, through a nozzle seal and through a nozzle into a die cavity, filling the die cavity and forming a cast part in the die cavity.

18. A method according to claim 13 wherein the step of causing the plunger to move in an upward direction creates a vacuum that pulls the plug assembly upward.

19. A method according to claim 15 wherein the step of causing the plunger to move in an upward direction creates a vacuum that pulls the plug assembly upwardly and wherein the vacuum also pulls molten metal from the reservoir through the bottom intake port into the chamber.

20. A method according to claim 19 wherein the molten metal in the reservoir has a weight that creates a head of pressure wherein the head of pressure pushes molten metal from the reservoir through the bottom intake port into the chamber when the plug assembly moves upwardly and opens the passageway of the bottom intake port.

21. A method according to claim 13 including including the step of lining the interior surface defining the channel through the gooseneck with a sleeve.

22. A method according to claim 21 wherein the sleeve has a bottom and including the step of providing a bottom intake port in the bottom of the sleeve.

23. A method according to claim 22 including the step of providing the bottom intake port of the sleeve with a passageway extending from the surface to the interior of the gooseneck.

24. A method according to claim 23 including the step of the bottom intake port of the sleeve housing the plug assembly.

25. A method according to claim 24 including the step of providing the plug assembly with an exterior plug wherein the exterior plug is a strainer.

26. A method according to claim 25 including the step of straining molten metal entering the gooseneck through the strainer.

* * * * *